US009901116B2

(12) United States Patent
Liu

(10) Patent No.: US 9,901,116 B2
(45) Date of Patent: Feb. 27, 2018

(54) BATTERY ASSEMBLY AND ELECTRONIC CIGARETTE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 470 days.

(21) Appl. No.: 14/096,934

(22) Filed: Dec. 4, 2013

(65) Prior Publication Data

US 2015/0107609 A1 Apr. 23, 2015

(30) Foreign Application Priority Data

Oct. 17, 2013 (CN) ..... 2013 2 0642916 U

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS 4,141,369 A * 2/1979 Burruss ..... A24F 1/00 128/203.27
2010/0083959 A1* 4/2010 Siller ..... A24F 47/006 128/202.21
2010/0307518 A1* 12/2010 Wang ..... A24F 47/008 131/329
2013/0284194 A1* 10/2013 Newton ..... A24F 47/002 131/329
2014/0014124 A1* 1/2014 Glasberg ..... A24F 47/008 131/328
2015/0090278 A1* 4/2015 Schiff ..... A24F 47/008 131/328
2015/0181942 A1* 7/2015 Holzherr ..... A24F 47/008 131/328

* cited by examiner

*Primary Examiner* — Eric Yaary
(74) *Attorney, Agent, or Firm* — Tim Tingkang Xia, Esq.; Locke Lord LLP

(57) ABSTRACT

The present application provides a battery assembly and an electronic cigarette; the battery assembly is configured for assembling with an atomizing assembly to form an electronic cigarette; and the battery assembly comprises a battery sleeve and a battery mounted in the battery sleeve; the battery includes a first electrode and a second electrode; and the battery assembly further comprises a first charging electrode connected to the first electrode electrically, and a second charging electrode connected to the second electrode electrically; and the first charging electrode is an end cover mounted on an end of the battery sleeve. The following advantageous effects can be achieved: only the end cover and the second charging electrode need to be connected to an external charger when the electronic cigarette need to be charged, which saves the time of a charging operation.

11 Claims, 8 Drawing Sheets

BATTERY ASSEMBLY AND ELECTRONIC CIGARETTE

CROSS-REFERENCE TO RELATED APPLICATIONS

This non-provisional application claims priority under 35 U.S.C. § 119(a) on Patent Application No. 201320642916.8, filed in P.R. China on Oct. 17, 2013, the entire contents of which are hereby incorporated by reference.

FIELD OF THE INVENTION

The present application relates to the field of daily electrical products, and more particularly relates to a battery assembly and an electronic cigarette.

BACKGROUND OF THE INVENTION

An electronic cigarette comprises a battery assembly and an atomizing assembly. In the prior art, the electronic cigarette includes a disposable electronic cigarette and a non-disposable electronic cigarette. The disposable electronic cigarette usually doesn't have a charging function, and tobacco juice in the disposable electronic cigarette cannot be used up usually, which causes the waste of the tobacco juice. In the non-disposable electronic cigarette, the battery assembly is detachably connected to the atomizing assembly. In the battery assembly, a charging interface of the battery assembly is an electrode connecting member connected to the atomizing assembly. When the battery assembly is charged, the atomizing assembly needs to be detached from the battery assembly, so that the battery assembly can be charged. FIG. 1 shows a charging schematic diagram of the battery assembly. However, it will cost much time and energy to adopt the aforementioned charging way, and connection portions between the atomizing assembly and the battery assembly will be worn or loose easily, after the charging way is adopted in a long time. Furthermore, the atomizing assembly will be lost, when the atomizing assembly is detached from the battery assembly, which is inconvenient for a user.

SUMMARY OF THE INVENTION

The objective of the present application is to provide a battery assembly and an electronic cigarette that are convenient to charge, aiming at aforementioned defects in the prior art.

The technical solutions of the present application for solving the technical problems are as follows: in one aspect, a battery assembly is configured for assembling with an atomizing assembly to form an electronic cigarette, the battery assembly comprises a battery sleeve and a battery mounted in the battery sleeve, and the battery includes a first electrode and a second electrode; the battery assembly further comprises a first charging electrode connected to the first electrode, and a second charging electrode connected to the second electrode; the first charging electrode and the second charging electrode are configured to connect to an external charger; the first charging electrode is an end cover mounted on an end of the battery sleeve, and a lamp disposed at internal side of the end cover and abuts the battery sleeve; and a plurality of through-holes are defined in an end surface of the end cover, and configured for lights, generated by the lamp, passing through the through-holes.

In one embodiment, the end cover includes a cover body inserted in an end of the battery sleeve, and the through-holes are distributed through the cover body uniformly.

In another embodiment, a marker setup area is arranged on an end surface of the cover body, the end surface is away from the battery sleeve; and the through-holes are disposed around the marker setup area uniformly.

In the embodiment, the marker setup area is located in the center of the end surface of the cover body.

In the embodiment, the end cover further includes a marker layer arranged on the marker setup area. The marker layer is concave and convex.

In a further embodiment, the through-holes form words and/or patterns.

In the aspect, the second charging electrode is inserted in an end of the battery sleeve, and the second charging electrode abuts against an internal surface of the battery sleeve; the end cover is mounted on the second charging electrode, and is electrically insulated from the second charging electrode.

In the aspect, the battery assembly further comprises an insulation sleeve mounted between the end cover and the second charging electrode; and end surfaces of the end cover, the second charging electrode and the insulation sleeve, that are away from the battery, are in a same surface. The end cover further includes an electrical connection portion formed by the cover body extending towards the battery; and the electrical connection portion is electrically connected to the first electrode. The cover body is made of metal, conductive rubber or conductive silicon.

In another aspect, an electronic cigarette comprises a battery assembly and an atomizing assembly, the battery assembly comprises a battery sleeve and a battery mounted in the battery sleeve, and the battery included a first electrode and a second electrode; and the battery assembly further comprises a first charging electrode connected to the first electrode electrically, and a second charging electrode connected to the second electrode; the first charging electrode and the second charging electrode are configured to connect to an external charger; and the first charging electrode is an end cover mounted on an end of the battery sleeve, and a lamp is disposed at internal side of the end cover and abuts the battery sleeve; a plurality of through-holes are defined in an end surface of the end cover, and configured for lights, generated by the lamp, passing through the through-holes.

In the aspect, the atomizing assembly includes an atomizing sleeve detachably connected to the battery sleeve or integrally formed with the battery sleeve; and the end cover is mounted on an end of the battery sleeve, that is away from the atomizing sleeve.

In one embodiment, the end cover includes a cover body inserted in an end of the battery sleeve; and the through-holes are distributed through the cover body uniformly.

In another embodiment, a marker setup area is arranged on an end surface of the cover body, the end surface is away from the battery sleeve, and the through-holes are disposed around the marker setup area uniformly. The through-holes form words and/or patterns.

In the aspect, the second charging electrode is inserted in an end of the battery sleeve, and the second charging electrode abuts against an internal surface of the battery sleeve; the end cover is mounted on the second charging electrode, and is electrically insulated from the second charging electrode.

In the aspect, the battery assembly further comprises an insulation sleeve mounted between the end cover and the second charging electrode; and end surfaces of the end cover, the second charging electrode and the insulation sleeve, that are away from the battery, are in a same surface.

In the aspect, the through-holes is tobacco-like linear.

In the aspect, the electronic cigarette further includes a control module configured for controlling the work of the atomizing assembly; the first electrode and the second electrode are electrically connected to the control module respectively; when an external charger charges the battery, the control module cuts off the electrical connection between the battery and the atomizing assembly.

When implementing the battery assembly and the electronic cigarette of the present application, the following advantageous effects can be achieved: because the first charging electrode of the battery assembly is the end cover mounted on an end of the battery sleeve, only the end cover and the second charging electrode need to be connected to an external charger when the electronic cigarette need to be charged, which saves the time of a charging operation in the prior art. Moreover, the external structure of battery assembly is simple, which avoids inconvenience for an extra charging electrode to assemble and increase of costs. As the battery sleeve doesn't need to be detached from the atomizing sleeve when the electronic cigarette is charged, the battery sleeve can be connected to the atomizing sleeve reliably, which is convenient for a user. Moreover, as a plurality of the through-holes can be defined in the end cover, so that the lights generated by the lamp can pass through the through-holes, the end cover can achieve all kinds of lighting effects to substitute burning of tobaccos, to meet psychological behavior demands of users, which improves the users' experience.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENT

To make the technical feature, objective and effect of the present application be understood more clearly, now the specific implementation of the present application is described in detail with reference to the accompanying drawings and embodiments.

Figure 1:
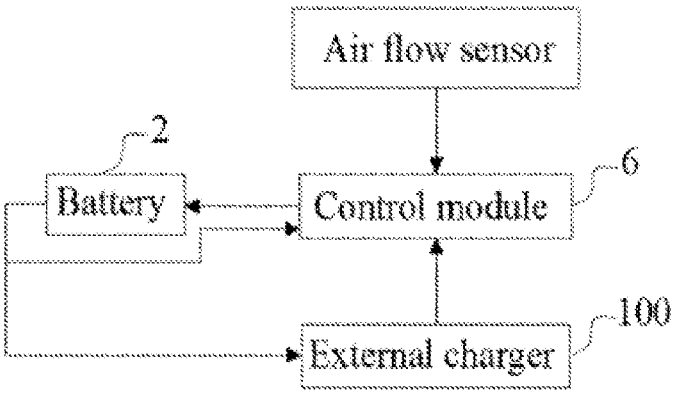
FIG. 1 is a charging schematic diagram of a battery assembly of an electronic cigarette in the prior art.
Figure 2:
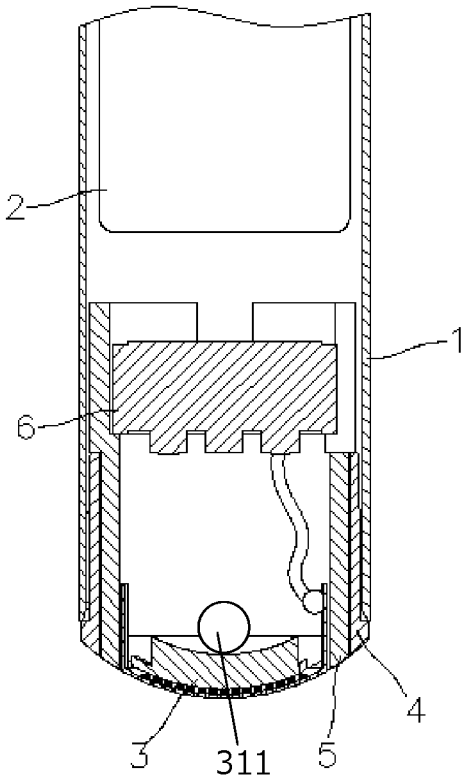
FIG. 2 is a structural schematic view of a battery assembly of a first preferred embodiment of the present application.
Figure 3:
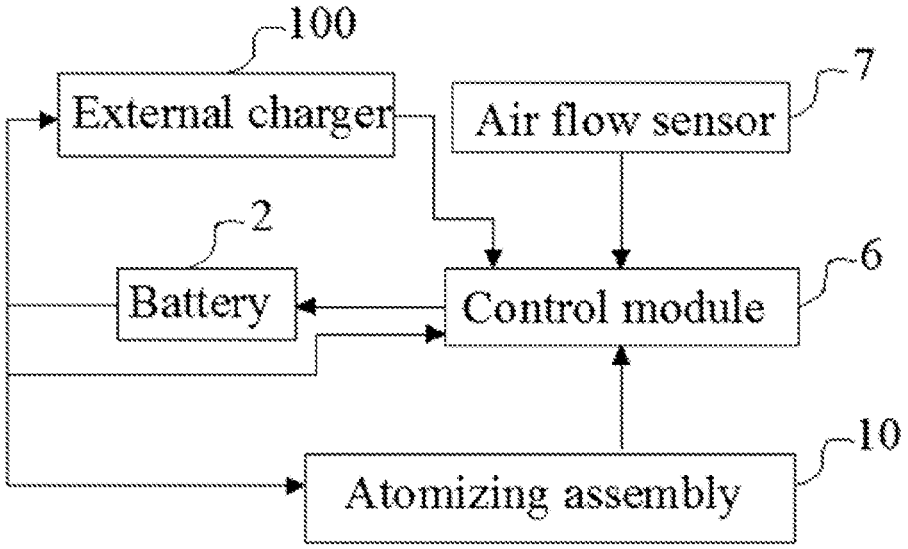
FIG. 3 is a charging schematic diagram of the battery assembly when the battery assembly shown in FIG. 2 is connected to an atomizing assembly.

As shown in FIGS. 2 and 3, in a battery assembly of a first preferred embodiment of the present application, the battery assembly is configured for assembling with an atomizing assembly 10 to form an electronic cigarette. The battery assembly comprises a battery sleeve 1, a battery 2, a first charging electrode, a second charging electrode 4, an insulation sleeve 5, a control module 6 and an airflow sensor 7.

Figure 4:
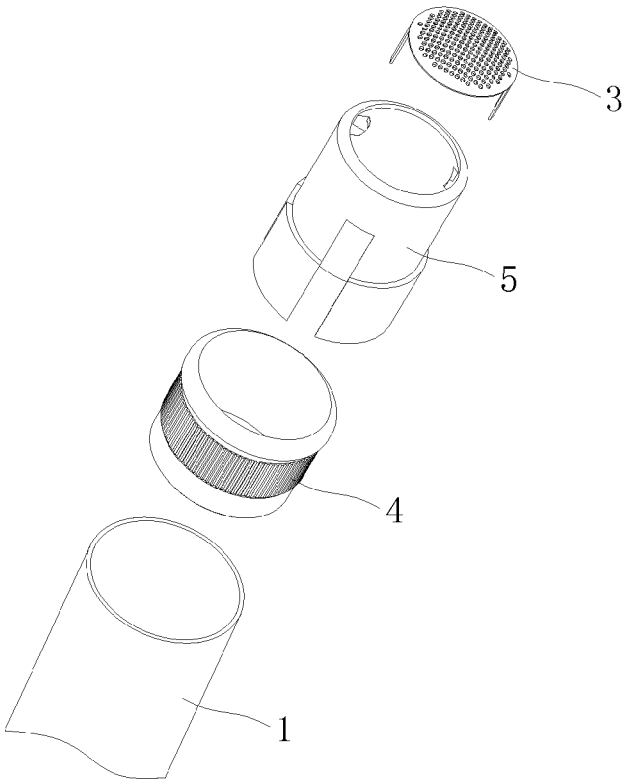
FIG. 4 is an exploded view of the battery assembly shown in FIG. 2.

As shown in FIGS. 2 and 4, the battery sleeve 1 is approximately a hollow cylindrical structure. The battery 2 includes a first electrode (not shown) and a second electrode (not shown), and the battery 2 is mounted in the battery sleeve 1. In this embodiment, the first electrode is an anode of the battery 2, and the second electrode is a cathode of the battery 2. The first electrode and the second electrode of the battery 2 are electrically connected to the atomizing assembly 10 of the electronic cigarette respectively, so that the atomizing assembly 10 can be driven to generate smoke configured for being smoked by a user.

Figure 5:
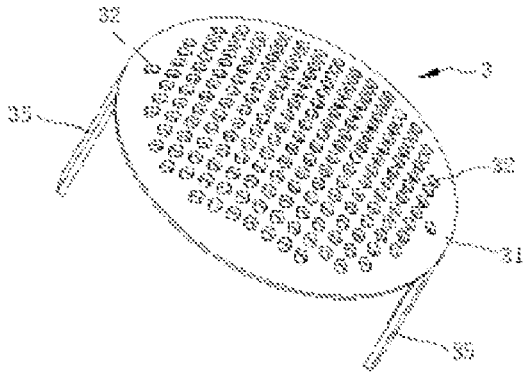
FIG. 5 is a perspective structural schematic view of an end cover of the battery assembly shown in FIG. 2.

As shown in FIGS. 2, 4 and 5, the first charging electrode is an end cover 3 mounted on an end of the battery sleeve 1, and the end cover 3 is electrically connected to the first electrode of the battery 2. The end cover 3 includes a cover body 31, a through-hole 32 and an electrical connection portion 35. The cover body 31 is approximately curved, and the cover body 31 is mounted on an end of the battery sleeve 1. A lamp 311 configured for simulating light emitted by burning tobaccos is disposed at internal side of the cover body 31 and abuts the battery sleeve 1. When the lamp 311 is working, the lights generated by the lamp 311 are emitted through the through-hole 32 to simulate burning of tobaccos vividly. When the electronic cigarette is smoked, the end cover 3 can achieve all kinds of lighting effects to meet psychological behavior demands of a user. In this embodiment, the cover body 31 is a thin plate, and is made of metal. In another embodiment of the present application, the cover body 31 can be made of conductive rubber or conductive silicon. When the atomizing assembly 10 is working, the end cover 3 emits lights to indicate that the atomizing assembly 10 is in working.

As shown in FIGS. 2, 4 and 5, the through-hole 32 is defined in an end surface of the end cover 3, that is, the through-hole 32 is defined in an end surface of the cover body 31. The through-hole 32 extends along a direction paralleled with an axial direction of the battery sleeve 1. In this embodiment, pluralities of the through-holes 32 are distributed through the cover body 31 uniformly. Moreover, the whole cover body 31 is covered by the through-holes 32 disposed into an array. The distance between any two through-holes 32 abutting each other is constant. The through-holes 32 are circular. In another embodiment of the present application, the through-holes 32 can be square, polygonal or tobacco-like linear, etc. The tobacco-like linear through-holes 32 are adopted to make the effects that the electronic cigarette simulates burning of tobaccos more vivid.

As shown in FIGS. 2 and 5, the electrical connection portion 35 is formed by the cover body 31 extending towards the battery 2, and the electrical connection portion 35 is electrically connected to the first electrode. In this embodiment, the electrical connection portion 35 is formed on the edge of the cover body 31, and is electrically soldered to the first electrode via a conductive wire.

As shown in FIG. 4, the second charging electrode 4 is electrically connected to the second electrode. The second charging electrode 4 is approximately ring structure, and is fit for an internal diameter of the battery sleeve 1. The second charging electrode 4 is inserted in an end of the battery sleeve 1, and the second charging electrode 4 abuts against an internal surface of the battery sleeve 1. The internal surface of the battery sleeve 1 is made of conductive material; the second charging electrode 4 and the internal surface of the battery sleeve 1 abut with each other, so that the second charging electrode 4 is electrically connected to the internal surface of the battery sleeve 1. Moreover, the second charging electrode 4 is electrically connected to the internal surface of the battery sleeve 1, so that the second charging electrode 4 is electrically connected to the second electrode. In another embodiment of the present application, the second charging electrode 4 can be also electrically soldered to the second electrode via a conductive wire.

As shown in FIGS. 2 and 4, the insulation sleeve 5 is approximately a hollow cylindrical structure. The insulation sleeve 5 is mounted between the end cover 3 and the second charging electrode 4, so that the end cover 3 is electrically insulated from the second charging electrode 4. End surfaces of the end cover 3, the second charging electrode 4 and the insulation sleeve 5, that are away from the battery 2, are in a same surface; that is, end surfaces of the end cover 3, the second charging electrode 4 and the insulation sleeve 5, that are away from the battery 2, form a smooth surface. In this embodiment, an end of the end cover 3 located out of the battery sleeve 1 is an arc-shaped structure. Correspondingly, an end of the second charging electrode 4 and an end of the insulation sleeve 5 located out of the battery sleeve 1 are arc-shaped structure, and the end of the end cover 3, the end of the second charging electrode 4 and the end of the insulation sleeve 5, that are located out of the battery sleeve 1, form a smooth arc-shaped surface.

As shown in FIGS. 2 and 3, an output terminal of the control module 6 is connected to the atomizing assembly 10, so that the control module 6 can control the work of the atomizing assembly 10. The first electrode and the second electrode are electrically connected to the control module 6 respectively, so that the control module 6 can be supplied with electric power. When an external charger 100 charges the battery 2, the control module 6 can cut off the electrical connection between the battery 2 and the atomizing assembly 10, so that the atomizing assembly 10 cannot generate smoke when the battery 2 is charged. The airflow sensor 7 is connected to the control module 6. When the battery assembly is connected to the atomizing assembly 10, and the battery assembly works normally, the control module 6 controls the battery 2 to supply electric power to the atomizing assembly 10 after receiving an airflow signal sensed by the airflow sensor 7, so that the atomizing assembly 10 is driven to generate smoke.

When the aforementioned battery assembly is used, because the first charging electrode of the battery assembly is the end cover 3 mounted on an end of the battery sleeve 1, only the end cover 3 and the second charging electrode 4 need to be connected to an external charger 100 to achieve the charging operation of the battery assembly, which saves the time of a charging operation.

Figure 6:
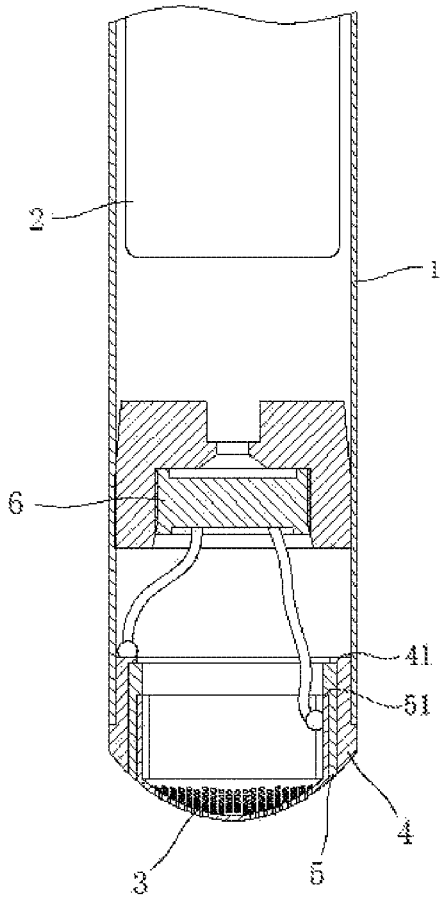
FIG. 6 is a structural schematic view of a battery assembly of a second preferred embodiment of the present application.
Figure 7:
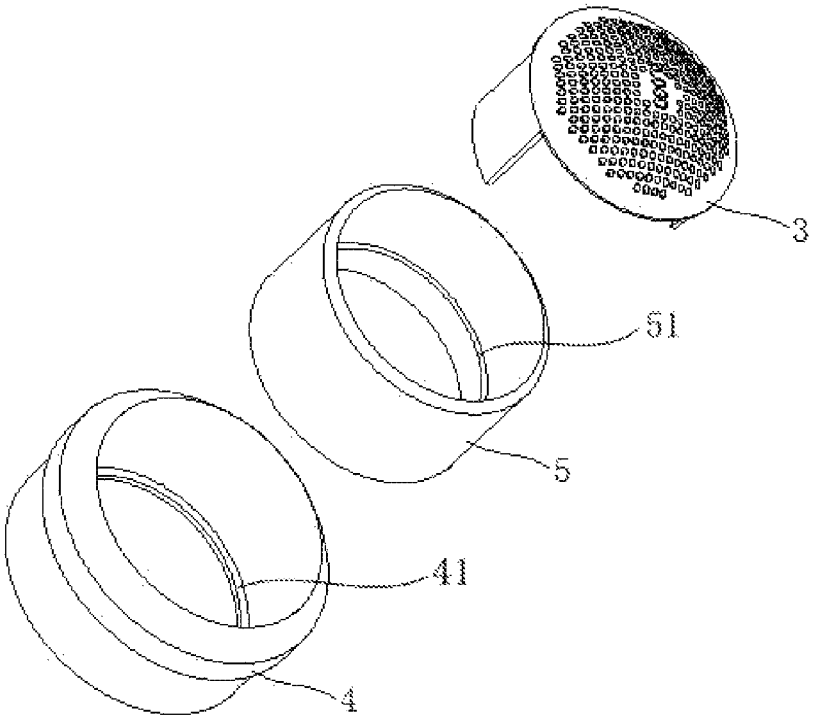
FIG. 7 is an exploded view of an end cover, a second charging electrode and an insulation sleeve of the battery assembly shown in FIG. 6.
Figure 8:
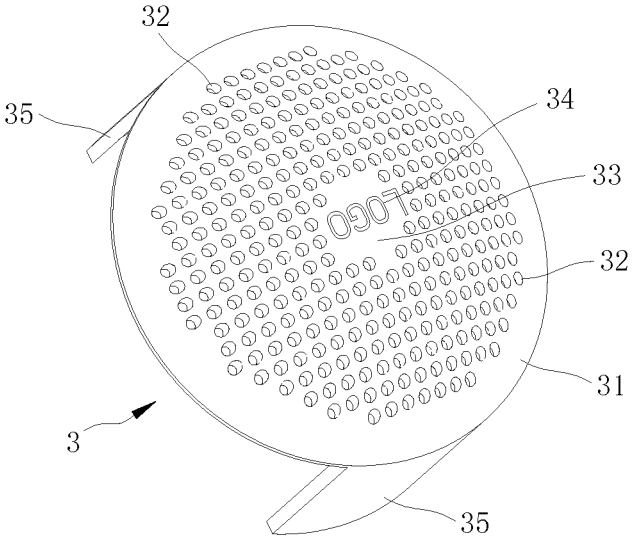
FIG. 8 is a perspective structural schematic view of the end cover of the battery assembly shown in FIG. 6.
Figure 9:
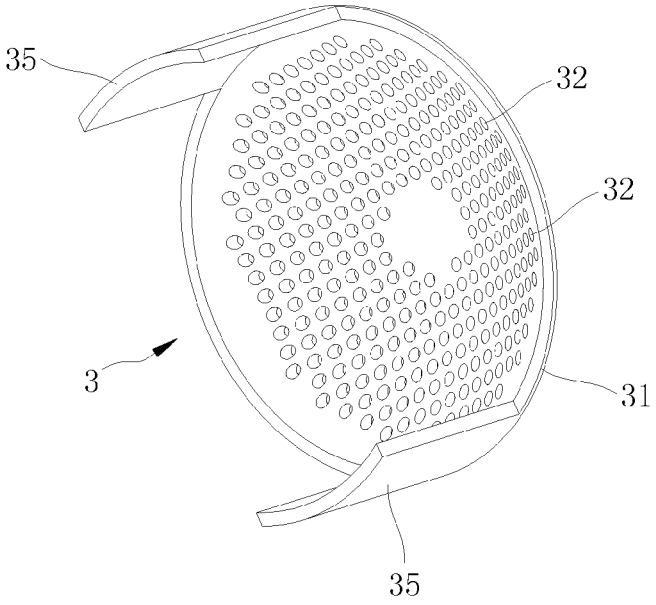
FIG. 9 is another perspective structural schematic view of the end cover of the battery assembly shown in FIG. 6.
Figure 10:
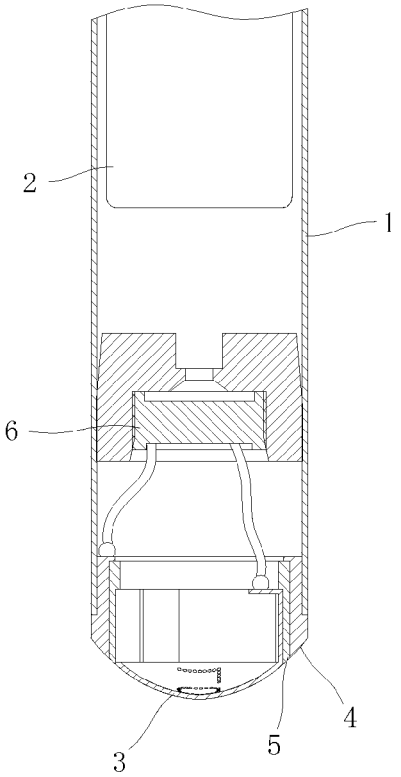
FIG. 10 is a structural schematic view of a battery assembly of a third preferred embodiment of the present application.
Figure 11:
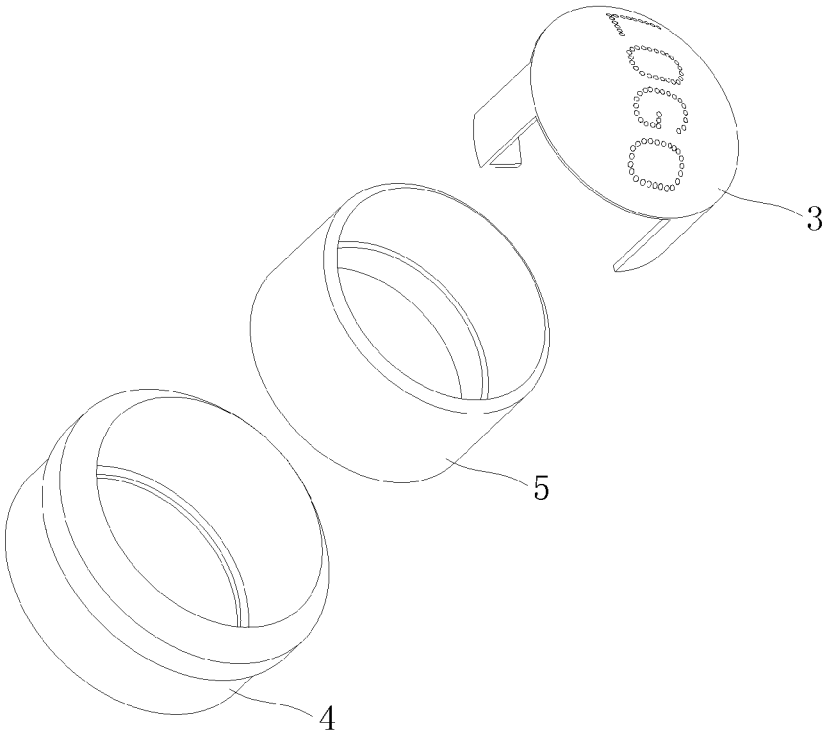
FIG. 11 is an exploded view of an end cover, a second charging electrode and an insulation sleeve of the battery assembly shown in FIG. 10.
Figure 12:
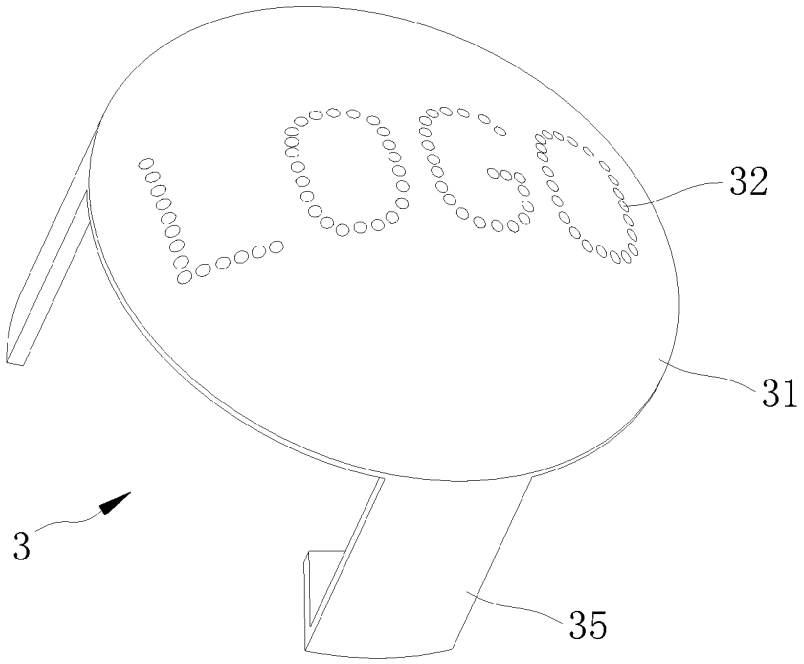
FIG. 12 is a perspective structural schematic view of the end cover of the battery assembly shown in FIG. 11.
Figure 13:
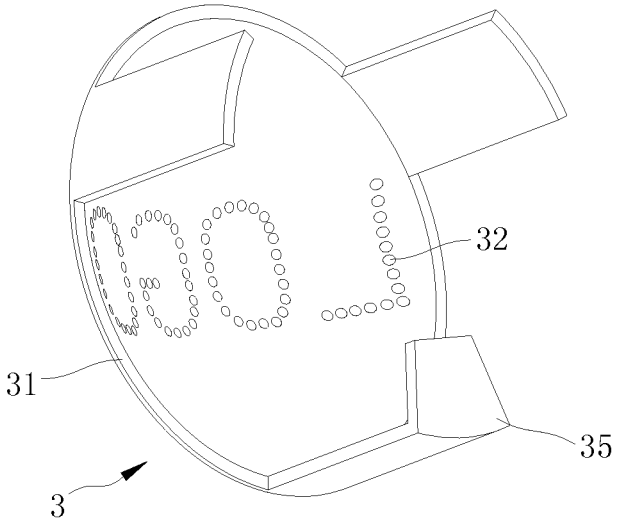
FIG. 13 is another perspective structural schematic view of the end cover of the battery assembly shown in FIG. 11.
Figure 14:
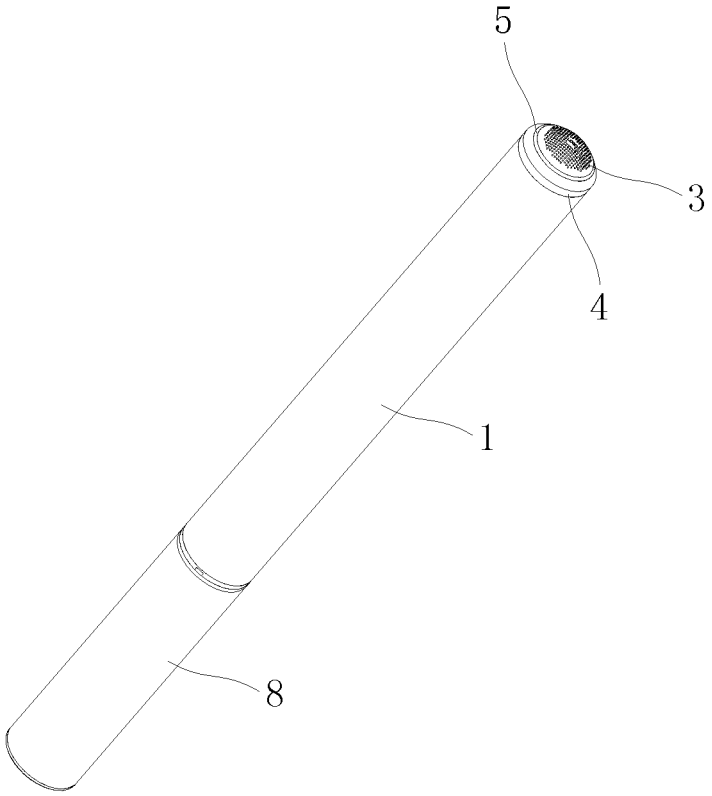
FIG. 14 is a structural schematic view of an electronic cigarette of a first preferred embodiment of the present application.
Figure 15:
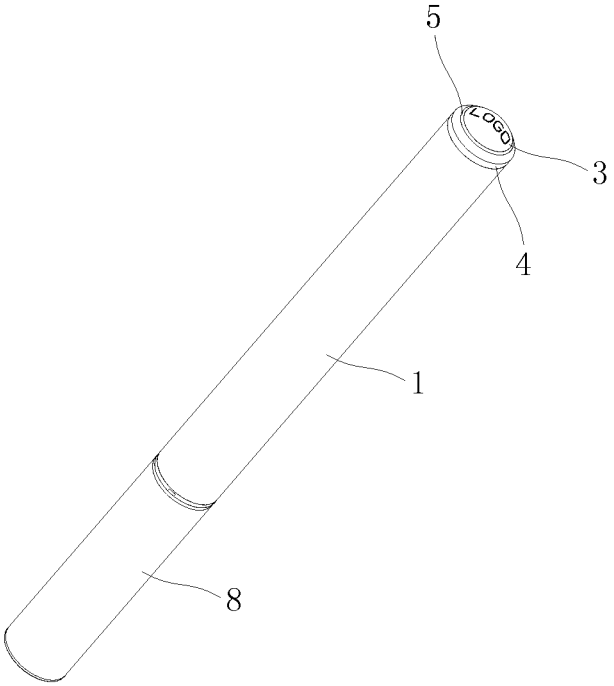
FIG. 15 is a structural schematic view when an end cover of the electronic cigarette shown in FIG. 14 is replaced.

As shown in FIGS. 6 to 9, in a battery assembly of a second preferred embodiment of the present application, the difference between the battery assembly of the second preferred embodiment and the battery assembly of the first preferred embodiment is the structures of the end covers 3. In the second embodiment, the end cover 3 further includes a logo setup area 33 and a marker layer 34. The marker setup area 33 is arranged on an end surface of the cover body 31 that is away from the battery sleeve 1. The marker setup area 33 is approximately circular; and a plurality of the through-holes 32 are disposed around the marker setup area 33 uniformly. In this embodiment, the marker setup area 33 is located in the center of the end surface of the cover body 31 that is away from the battery sleeve 1, and the marker layer 34 is arranged on the marker setup area 33. The marker setup area 33 can be designed based on the size of the marker layer 34. The marker layer 34 can be pasted or painted on the marker setup area 33. The marker layer 34 is concave and convex. The marker layer 34 can be designed as a trademark of a product. In another embodiment of the present application, the marker layer 34 can be smooth. Further, as shown in FIG. 6 and FIG. 7, a first limiting step 41 is defined at an inner sidewall of the second charging electrode 4 for stopping the insulation sleeve 5 moving along an axial direction of the electronic cigarette, a second limiting step 51 is defined at an inner sidewall of the insulation sleeve 5 for stopping the end cover 3 moving along an axial direction of the electronic cigarette.

As shown in FIGS. 10 to 13, in a battery assembly of a third preferred embodiment of the present application, the difference between the battery assembly of the third preferred embodiment and the battery assembly of the first preferred embodiment is still the structures of the end covers 3. In the third embodiment, a plurality of the through-holes 32 form words and/or patterns, that is, a plurality of the through-holes 32 can form words, patterns, or a design with words and patterns. By adopting the aforementioned structure of the third embodiment, a plurality of the through-holes 32 can be designed as different designs according to demands of users, so that the end cover 3 can achieve different lighting effects to meet diversified demands of users.

As shown in FIGS. 2, 3, 14 and 15, based on the aforementioned battery assembly, the present application further provides an electronic cigarette, and the electronic cigarette comprises the atomizing assembly 10 and the battery assembly. The atomizing assembly 10 includes an atomizing sleeve 8 detachably connected to the battery sleeve 1 or integrally formed with the battery sleeve 1. In an electronic cigarette of a first preferred embodiment of the present application, the battery sleeve 1 is detachably connected to the atomizing sleeve 8. Advantageously, the battery sleeve 1 is connected to the atomizing sleeve 8 by threads. The battery 2 is mounted in the battery sleeve 1, and the end cover 3 is mounted on an end of the battery sleeve 1 that is away from the atomizing sleeve 8. In another embodiment of the present application, the battery sleeve 1 can be detachably connected to the atomizing sleeve 8 by adopting another connection method, such as buckling connection, etc.

Figure 16:
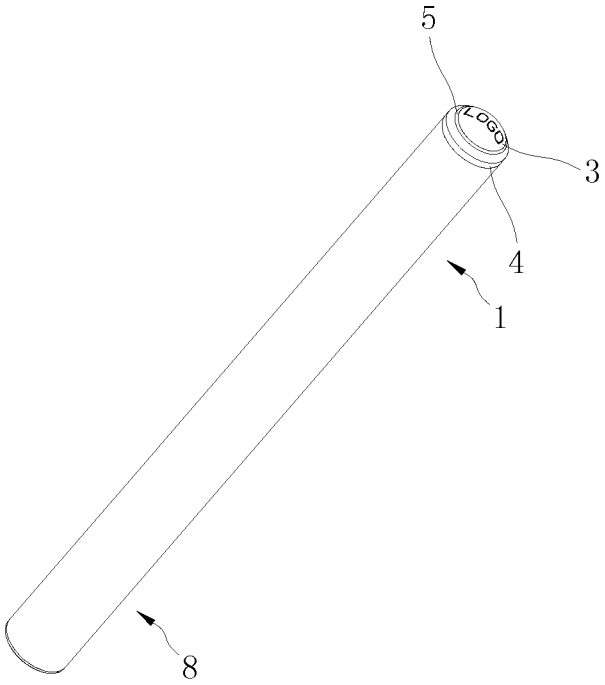
FIG. 16 is a structural schematic view of an electronic cigarette of a second preferred embodiment of the present application.

As shown in FIG. 16, in an electronic cigarette of a second preferred embodiment of the present application, the difference between the electronic cigarette of the second preferred embodiment and the electronic cigarette of the first preferred embodiment is the structures of the battery sleeves 1. The electronic cigarette of the second preferred embodiment comprises the battery assembly of the first preferred embodiment and the atomizing assembly 10 of the first preferred embodiment, and the battery sleeve 1 of the battery assembly is integrated with the atomizing sleeve 8. The electronic cigarette of the second preferred embodiment is a normal disposable electronic cigarette.

When the aforementioned electronic cigarette is used, because the first charging electrode of the battery assembly is the end cover 3 mounted on an end of the battery sleeve 1, only the end cover 3 and the second charging electrode 4 need to be connected to an external charger 100 when the electronic cigarette need to be charged, which saves the time of a charging operation in the prior art. As the battery sleeve 1 doesn't need to be detached from the atomizing sleeve 8 when the electronic cigarette is charged, the battery sleeve 1 can be connected to the atomizing sleeve 8 reliably, which is convenient for a user. Moreover, as a plurality of the through-holes 32 can be defined in the end cover 3, so that the lights generated by the lamp can pass through the through-holes 32, the end cover 3 can achieve all kinds of lighting effects to meet diversified demands of users.

While the embodiments of the present application are described with reference to the accompanying drawings above, the present application is not limited to the above-mentioned specific implementations. In fact, the above-mentioned specific implementations are intended to be exemplary not to be limiting. In the inspiration of the present application, those ordinary skills in the art can also make many modifications without breaking away from the subject of the present application and the protection scope of the claims. All these modifications belong to the protection of the present application.

What is claimed is:

1. A battery assembly configured for assembling with an atomizing assembly to form an electronic cigarette, the battery assembly comprising a battery sleeve and a battery mounted in the battery sleeve; the battery including a first electrode and a second electrode, wherein the battery assembly further comprises a first charging electrode connected to the first electrode and a second charging electrode connected to the second electrode; the first charging electrode and the second charging electrode are configured to connect to an external charger;

wherein the first charging electrode is an end cover mounted on an end of the battery sleeve, and a lamp is disposed at internal side of the end cover and abuts the battery sleeve; and a plurality of through-holes are defined in an end surface of the end cover, and configured for lights, generated by the lamp, passing through the through-holes;

wherein the end cover includes a cover body inserted in an end of the battery sleeve, an electrical connection portion formed by the cover body extending towards the battery, and the electrical connection portion is formed on an edge of the cover body, the electrical connection portion is electrically connected to the first electrode;

wherein the battery assembly further comprises an insulation sleeve mounted between the end cover and the second charging electrode;

wherein an end of the end cover, an end of the second charging electrode and an end of the insulation sleeve located out of the battery sleeve are arc-shaped structures and are in a same surface, forming a smooth arc-shaped surface; a first limiting step is defined at an inner sidewall of the second charging electrode for stopping the insulation sleeve moving along an axial direction of the electronic cigarette, a second limiting step is defined at an inner sidewall of the insulation sleeve for stopping the end cover moving along an axial direction of the electronic cigarette;

wherein the through-holes are linear, and the through-holes used for simulating burning of tobaccos are distributed through the cover body uniformly;

wherein the second charging electrode is inserted in an end of the battery sleeve, and the second charging electrode abuts against an internal surface of the battery sleeve; the end cover is mounted on the second charging electrode, and is electrically insulated from the second charging electrode;

wherein the internal surface of the battery sleeve is made of conductive material; the second charging electrode and the internal surface of the battery sleeve abut with each other, so that the second charging electrode is electrically connected to the internal surface of the battery sleeve;

wherein the electronic cigarette further includes a control module configured for controlling work of the atomizing assembly; the first electrode and the second electrode are electrically connected to the control module respectively; when an external charger charges the battery, the control module cuts off the electrical connection between the battery and the atomizing assembly;

wherein the electronic cigarette further includes an airflow sensor connected to the control module; when the battery assembly is connected to the atomizing assembly, and the battery assembly works normally, the control module controls the battery to supply electric power to the atomizing assembly after receiving an airflow signal sensed by the airflow sensor, so that the atomizing assembly is driven to generate smoke.

2. The battery assembly according to claim 1, wherein a marker setup area is arranged on an end surface of the cover body, the end surface is away from the battery sleeve; and the through-holes are disposed around the marker setup area uniformly; wherein the marker setup area is an area that does not include through-holes.

3. The battery assembly according to claim 2, wherein the marker setup area is located in the center of the end surface of the cover body.

4. The battery assembly according to claim 2, wherein the end cover further includes a marker layer arranged on the marker setup area.

5. The battery assembly according to claim 4, wherein the marker layer is concave and convex.

6. The battery assembly according to claim 1, wherein the through-holes form words and/or patterns.

7. The battery assembly according to claim 1, wherein the cover body is made of metal, conductive rubber or conductive silicon.

8. An electronic cigarette comprising a battery assembly and an atomizing assembly, the battery assembly comprising a battery sleeve and a battery mounted in the battery sleeve;

the battery including a first electrode and a second electrode, wherein the battery assembly further comprises a first charging electrode connected to the first electrode, and a second charging electrode connected to the second electrode; the first charging electrode and the second charging electrode are configured to connect to an external charger;

wherein the first charging electrode is an end cover mounted on an end of the battery sleeve, and a lamp is disposed at internal side of the end cover and abuts the battery sleeve; and a plurality of through-holes are defined in an end surface of the end cover, and configured for lights, generated by the lamp, passing through the through-holes;

wherein the end cover includes a cover body inserted in an end of the battery sleeve, an electrical connection portion formed by the cover body extending towards the battery, and the electrical connection portion is formed on an edge of the cover body, the electrical connection portion is electrically connected to the first electrode;

wherein the battery assembly further comprises an insulation sleeve mounted between the end cover and the second charging electrode;

wherein an end of the end cover, an end of the second charging electrode and an end of the insulation sleeve located out of the battery sleeve are arc-shaped structures and are in a same surface, forming a smooth arc-shaped surface, a first limiting step is defined at an inner sidewall of the second charging electrode for stopping the insulation sleeve moving along an axial direction of the electronic cigarette, a second limiting step is defined at an inner sidewall of the insulation sleeve for stopping the end cover moving along an axial direction of the electronic cigarette;

wherein the through-holes are linear, and the through-holes used for simulating burning of tobaccos are distributed through the cover body uniformly;

wherein the second charging electrode is inserted in an end of the battery sleeve, and the second charging electrode abuts against an internal surface of the battery sleeve; the end cover is mounted on the second charging electrode, and is electrically insulated from the second charging electrode;

the internal surface of the battery sleeve is made of conductive material, the second charging electrode and the internal surface of the battery sleeve abut with each other, so that the second charging electrode is electrically connected to the internal surface of the battery sleeve;

wherein the electronic cigarette further includes a control module configured for controlling work of the atomizing assembly; the first electrode and the second electrode are electrically connected to the control module respectively; when an external charger charges the battery, the control module cuts off the electrical connection between the battery and the atomizing assembly;

wherein the electronic cigarette further includes an airflow sensor connected to the control module; when the battery assembly is connected to the atomizing assembly, and the battery assembly works normally, the control module controls the battery to supply electric power to the atomizing assembly after receiving an airflow signal sensed by the airflow sensor, so that the atomizing assembly is driven to generate smoke.

9. The electronic cigarette according to claim 8, wherein the atomizing assembly includes an atomizing sleeve detachably connected to the battery sleeve or integrally formed with the battery sleeve; and the end cover is mounted on an end of the battery sleeve, the end is away from the atomizing sleeve.

10. The electronic cigarette according to claim 8, wherein a marker setup area is arranged on an end surface of the cover body, the end surface is away from the battery sleeve; and the through-holes are disposed around the marker setup area uniformly; wherein the marker setup area is an area that does not include through-holes.

11. The electronic cigarette according to claim 8, wherein the through-holes form words and/or patterns.

* * * * *